US007171761B1

(12) United States Patent
Hunts

(10) Patent No.: US 7,171,761 B1
(45) Date of Patent: Feb. 6, 2007

(54) LARGE PLUSH TOWEL WARMER AND DEHUMIDIFIER

(76) Inventor: Barney Dean Hunts, 17 Reeve Ave., Stanhope, NJ (US) 07874

( * ) Notice: Subject to any disclaimer, the term of this patent is extended or adjusted under 35 U.S.C. 154(b) by 51 days.

(21) Appl. No.: 11/195,386

(22) Filed: Aug. 2, 2005

(51) Int. Cl.
*F26B 19/00* (2006.01)

(52) U.S. Cl. ..... 34/91; 34/202; 34/215; 34/225; 219/400; 219/521; 432/266

(58) Field of Classification Search ..... 34/90, 34/91, 202, 215, 225; 219/400, 521; 432/266
See application file for complete search history.

(56) References Cited

U.S. PATENT DOCUMENTS

| | | | | |
|---|---|---|---|---|
| 3,323,279 | A * | 6/1967 | Matsui | 53/520 |
| 3,839,622 | A * | 10/1974 | Mastin | 219/400 |
| 4,918,290 | A * | 4/1990 | DeMars | 219/400 |
| 5,369,892 | A * | 12/1994 | Dhaemers | 34/275 |
| 5,555,640 | A * | 9/1996 | Ou | 34/202 |
| 5,829,161 | A * | 11/1998 | Hung et al. | 34/202 |
| 6,046,436 | A * | 4/2000 | Hunts | 219/400 |
| 6,189,230 | B1 * | 2/2001 | Huen | 34/90 |
| 6,525,298 | B1 * | 2/2003 | Hunts | 219/400 |
| 6,693,260 | B1 * | 2/2004 | Rodrigues | 219/385 |
| 2002/0129514 | A1 * | 9/2002 | Sharp | 34/611 |
| 2006/0049172 | A1 * | 3/2006 | Gagas et al. | 219/521 |

* cited by examiner

*Primary Examiner*—S. Gravini

(57) ABSTRACT

An increased air pressure forced hot air towel warmer comprising a substantially airtight enclosure configured to be more desirable and user friendly when placed in close proximity to a tub or shower whether mounted within cabinetry, on the wall or when permanently installed between existing standard 16 inch on center wall support studs while protruding as little as possible into the room. Intended for use with large area plush towels and bath sheets for which insertion in a limited width wall enclosure or shallow depth cabinetry leads to greater vertical depth of towel material to be penetrated and substantially increases the resistance to air flow, therefore back pressure, thereby necessitating increased supply pressure to maintain adequate hot air flow through the towel. Increased supply pressure is created without objectionable noise by use of low noise rotary blowers and associated pressure accumulator cavities arranged in tandem such that their respective pressure gradients are additive. Experience has also shown that all towels exhibit some degree of adsorbed moisture, the present invention includes an embodiment for increasing user satisfaction by removing excess adsorbed moisture during the warming cycle to achieve dehumidification by means of periodic short time interval ejection of the warmed moisture laden air within the enclosure with simultaneous replacement by room air to sequentially reduce the moisture content retained within the warmed towel.

18 Claims, 6 Drawing Sheets

LARGE PLUSH TOWEL WARMER AND DEHUMIDIFIER

BACKGROUND OF THE INVENTION

The present invention relates to bathroom towel warmers and more particularly to improved hot air towel warmer configurations intended for use with large area plush bath towels and bath sheets whose size and material volume increase the difficulty of achieving sufficient air passage through the towel to assure heating adequately within the time of a typical bath or shower.

It is Applicants desire to provide in a bath or shower area a compact, esthetically attractive device capable of achieving rapid, uniform heating of articles such as clothing or towels and the like as a preliminary to use. A primary objective of the present invention is to assure adequate air flow through increased depth towel fabric by using readily available low cost blowers oriented in tandem. It is a further objective of the present invention to provide a physical embodiment including a means for removing excess adsorbed moisture during the warming cycle to achieve dehumidification.

Experience has shown that towel warmers in close proximity to a tub or shower have an increased satisfaction factor. In order to be as unobtrusive and aesthetically pleasing as possible it is preferable to minimize the depth dimension of a towel warmer such that it protrudes as little as possible into the room. In some bathroom designs it is even desired to embed a permanent towel warmer in the wall between the support studs which in the U.S. are on standard 16 inch centers. A problem arises with shallow depth towel warmers used in conjunction with large, plush towels particularly those referred to as oversized bath towels and even more so for bath sheets in that the resulting vertical height of the inserted towel increases to the point that the flow of air through the towel is restricted, reducing the towel warmers ability to quickly and uniformly heat the towel and increasing the possibility that the heater coil will overheat due to inadequate air flow.

Experience has also shown that all towels contain some degree of adsorbed moisture the amount of which varies depending on multiple variables including but not limited to the local humidity, the storage enclosure, the time duration since the towel was laundered and dried and whether the using individual selected a fresh towel or elected a common practice of reusing a towel used on a previous occasion. What is further disclosed here is a physical embodiment and associated control system to increase the users satisfaction by reducing the amount of moisture adsorbed on the towel, that is by dehumidifying the towel during heating.

BRIEF SUMMARY OF THE INVENTION

An object of the present invention is to provide a rapid response, safe, aesthetically pleasing shallow depth towel warmer which is more desirable and user friendly when placed in close proximity to a tub or shower whether mounted within cabinetry, on the wall or when permanently installed between existing standard 16 inch on center wall support studs.

An ultimate purpose of the present invention is to rapidly and uniformly heat a large plush towel, without any possibility of damage to the towel, to a satisfactory end temperature within the short time duration of a typical shower, about 7 to 10 minutes. As the size and vertical height of the inserted towel increases, its greater effective filter depth causes an increased resistance to the flow of air through the towel necessitating increased pressure to assure the proper air flow rate required to maintain a short heating time. Currently available quiet, low cost blowers that are adequate when only a few layers of towel are involved do not sustain a sufficient pressure gradient to penetrate the depth of towel anticipated in this invention and substitution of higher rpm blowers creates unacceptable noise levels that are irritating to the user. In this invention a multiplicity of lower rpm, quiet blowers are configured in tandem such that their individual serial pressure gradients add to produce the overall pressure required to assure adequate air flow.

It has been found that the most time efficient method of uniformly heating a towel is total immersion, in which each individual cotton fiber is in direct contact with the heated medium, hot air in the case of the present invention. Normally the hot air towel warmer disclosed is completely enclosed in a substantially airtight configuration and recirculates the hot air so that the towel can be warmed quickly regardless of whether the towel is neatly folded or in a crumpled condition when inserted into the substantially airtight enclosure.

A further purpose of the present invention is to provide a dehumidifying embodiment in which the return air plenum positioned just above the cavity in which the towel is heated contains moveable internal baffles which are used to vary the air flow internal to the towel warmer. Under command of an electronic timing and control unit, the towel warmer of the current invention periodically actuates these internal baffles to allow fresh air from the bathroom to displace the internal moisture laden air which is caused to pass through the tandem blowers, the heater, the towel and subsequently out an exhaust duct.

As the towel heats it releases its adsorbed moisture which then raises the moisture content, or humidity of the surrounding air, this moisture laden air is periodically ejected from within the enclosure and replaced with room air thereby sequentially reducing the moisture content retained within the towel. The periods during which air is caused to flow through the unit rather than re-circulating constitute only a small portion of the overall control cycle, each flow through period ideally lasting only long enough to eject one unit volume of the towel heater internal capacity.

BRIEF DESCRIPTION OF THE SEVERAL VIEWS OF THE DRAWING

Above-mentioned and other features and objects of the present invention will become more apparent by reference to the following description taken in conjunction with the accompanying drawing, in which.

DETAILED DESCRIPTION OF THE INVENTION

Figure 1:
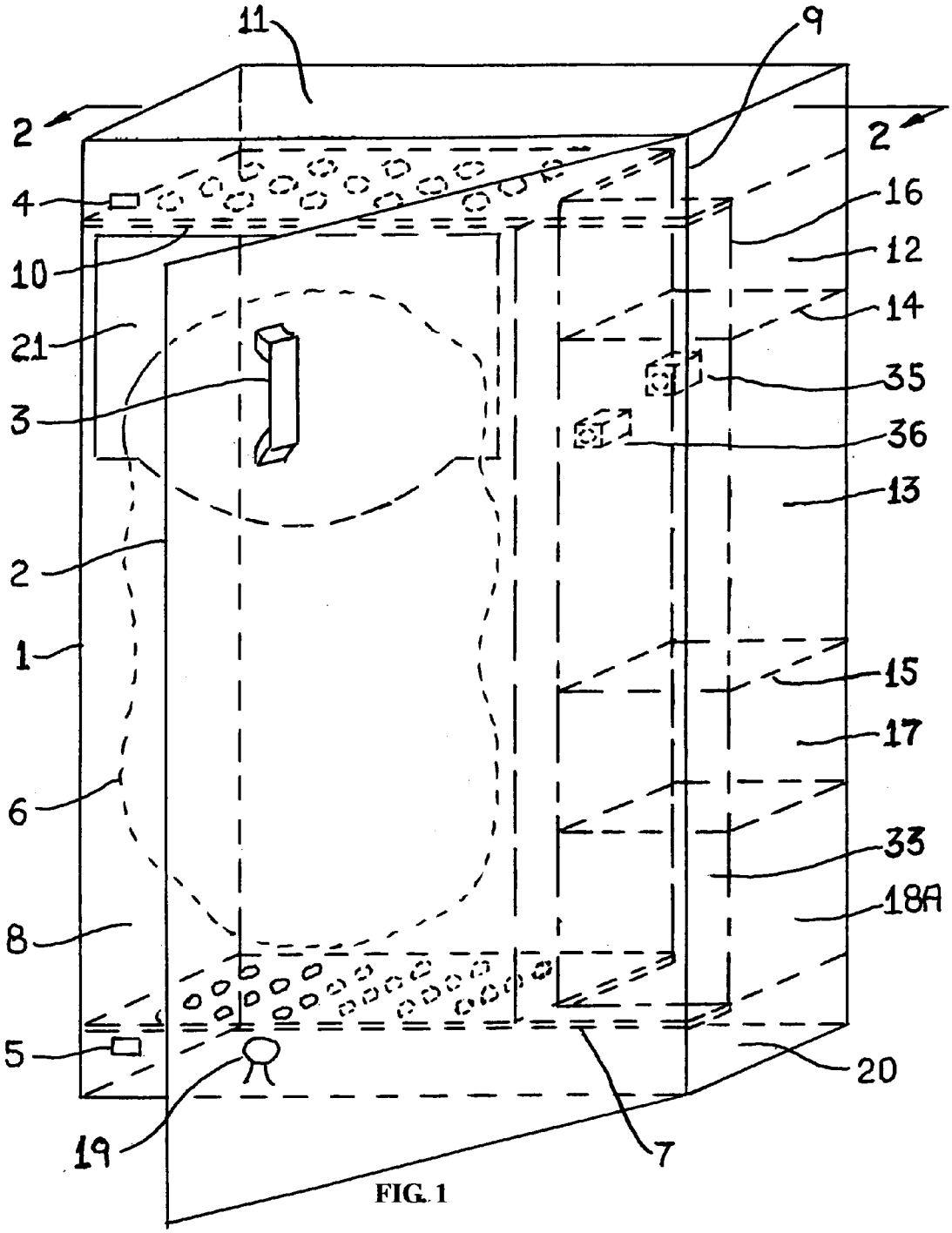
FIG. 1 is a perspective view of the first embodiment of the hot air towel warmer in accordance with the principles of the present invention configured for large plush towels and without the dehumidification capability for permanent installation embedded within the bathroom wall between adjacent studs, illustrated with the access door open.
Figure 2:
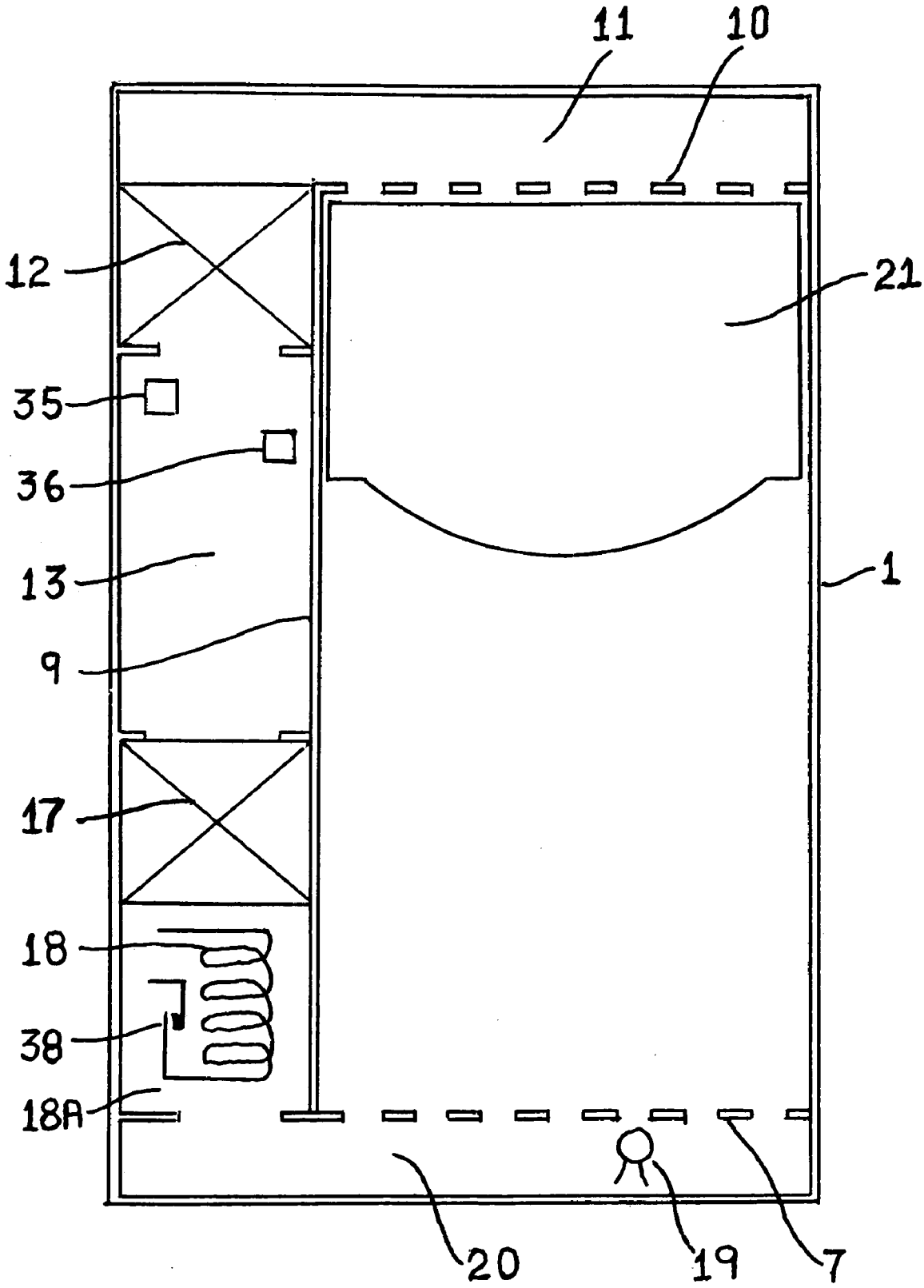
FIG. 2 is a cross-sectional view of the hot air towel warmer taken along line 2—2 at FIG. 1.

Referring to FIGS. 1 and 2, the present invention includes a substantially airtight enclosure 1 having a sealable access means in the form of a door 2 which is moveable into a closed position by handle 3 and held in a closed position by a magnet or similar catches 4 and 5. Door 2 enables placing a towel 6 to be warmed in the enclosure 1 and to enable removing the warm towel 6 from enclosure 1. As illustrated in FIG. 1, the towel 6 is in a rumpled condition, but it could just as well be in a neatly folded condition, since regardless of the condition of the towel 6, it is completely warmed throughout its bulk by means of total immersion in the temperature controlled forced hot air being circulated within enclosure 1.

A first means in the form of a shelf 7 to support the towel 6 and having perforated air passages there through is disposed within the air tight enclosure 1. The cavity 8 in which the towel is heated is defined by the access means door 2, first means shelf 7, first internal bulkhead 9, upper baffle 10 and the rear and side walls of the substantially airtight enclosure 1. The upper baffle 10 having perforated air passages there through is disposed within the air tight enclosure 1 above the towel heating cavity 8 and below the top of enclosure 1 thereby defining a return air plenum 11 and ensuring that the towel is not sucked into the supply blower 12.

A second means consisting of a supply blower 12 and associated pressure accumulator chamber 13 which together create and pre-pressurize a stream of air is positioned in close proximity to the return air plenum 11 in order to minimize the distance and resistance to flow of air exiting the towel heating cavity 8 before entering the supply blower 12. The pressure accumulator chamber 13 is defined by partitions 14 and 15, first internal bulkhead 9, second internal bulkhead 16, and the back and side walls of the substantially airtight enclosure 1.

A third means consisting of a primary blower 17 to further pressurize and continuously circulate the stream of air within the enclosure 1 is disposed between the pressure accumulator chamber 13 and immediately adjacent the fourth means 18.

A fourth means in the form of a resistance coil heater 18 is disposed in chamber 18A of enclosure 1 adjacent the primary blower 17 to heat the air stream and, hence, the towel 6. This single heater 18, continuously cooled by the air which is passing through the towel is capable of heating a plush bath sheet within the desired time interval when drawing current from a standard 20 amp, 110 volt household electrical circuit.

A fifth means disposed within the substantially air tight enclosure 1 adjacent the first means 7 and chamber 18A contains a temperature sensor 19 and comprises a constant temperature antechamber 20 in which a volume of pressurized air maintained within a predetermined temperature range is caused to continuously impinge on the towel to be heated. The bottom, rear, front and side walls of the enclosure 1 form the corresponding walls of this antechamber 20.

In operation the time required to heat the towel is determined by the rate of flow of essentially constant temperature heated air through the towel, this flow rate is directly effected by the depth of the towel to be penetrated hence its resistance to flow and the subsequent pressure differential across the towel. The second means may be replicated if the towel pressure requirement so dictates, the two stage tandem blower configuration consisting of supply blower 12, pressure accumulator chamber 13, primary blower 17 and temperature controlled antechamber 20 is shown herein for simplicity, it provides twice the pressure gradient across the towel than that which is possible with either blower operating separately. The towel to be heated is placed within and removed from the towel warming chamber 8 through the access opening 21 located in the front wall of enclosure 1.

Figure 4:
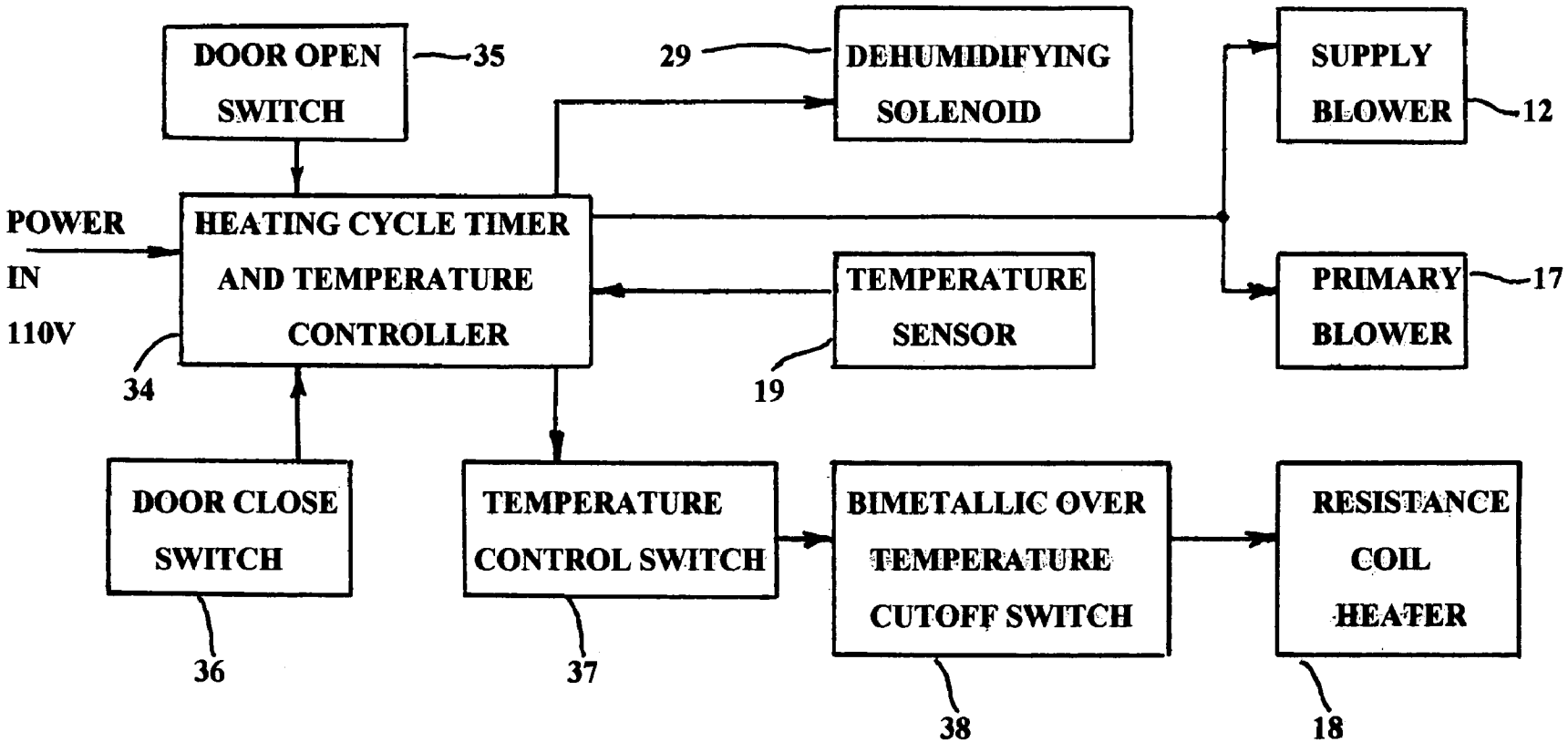
FIG. 4 is a block diagram of the electrical control system compatible with hot air towel warmers of either the first embodiment or the second embodiment in accordance with the principles of the present invention including connection for the actuation solenoid required for the dehumidifying embodiment.

A sixth means shown in block diagram form in FIG. 4 consisting of an electronic circuit positioned within internal cavity 33, a self contained volume bounded by internal bulkheads 9 and 16, shelf 7, baffle 10 and the front wall of enclosure 1, together with temperature sensor 19 disposed within the temperature controlled antechamber 20, is provided to control the operation of the hot air towel warmer, in accordance with the principles of the present invention.

Figure 3:
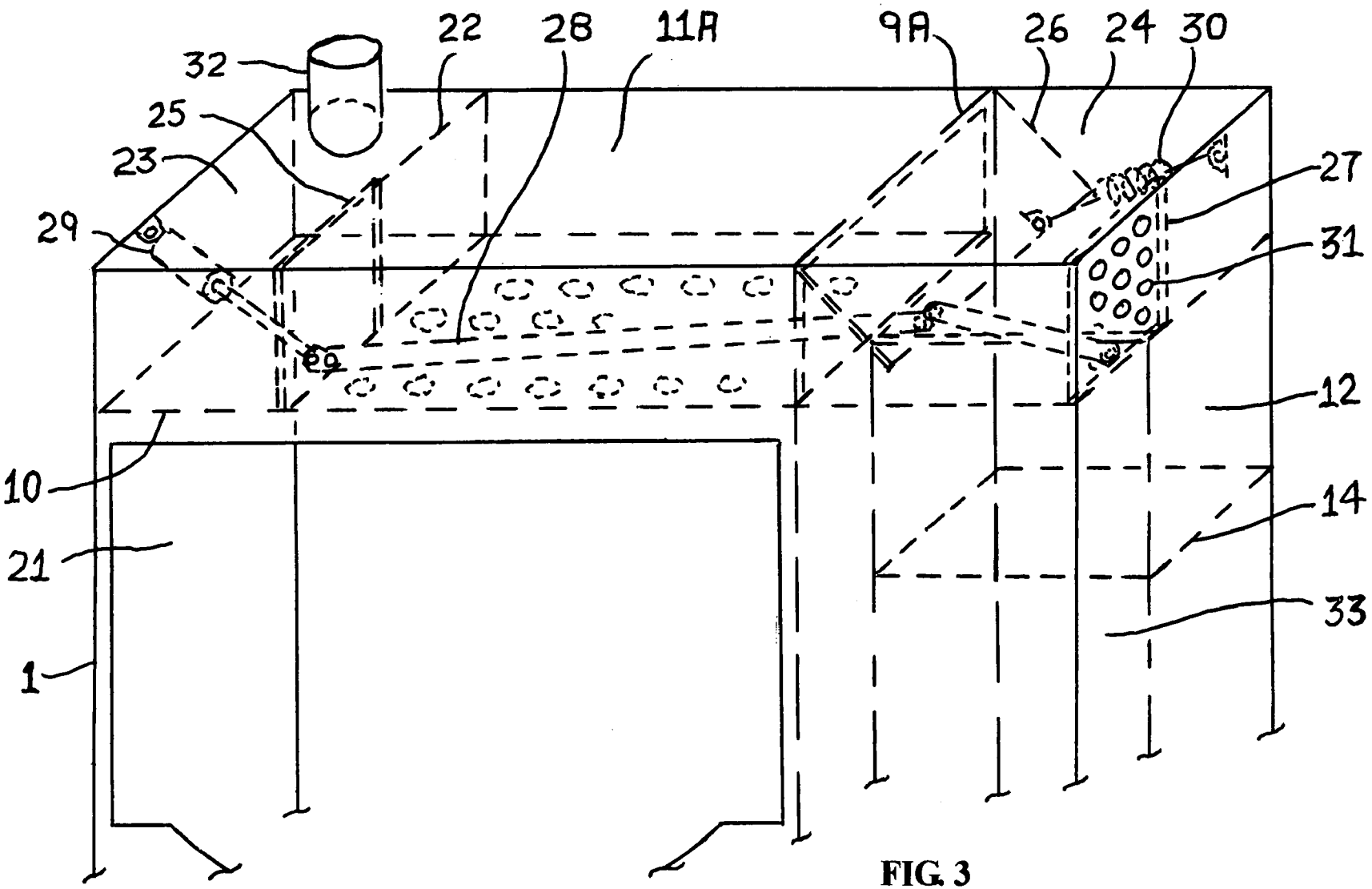
FIG. 3 is a perspective view illustrating the modified return air plenum used for the second embodiment of the combination hot air large plush towel warmer and dehumidifier in accordance with the principles of the present invention.

A seventh means is illustrated in FIG. 3 consisting of a variable air flow path return air plenum used for the towel dehumidifying embodiment of the large plush towel hot air warmer illustrated in FIG. 1 in accordance with the principles of the present invention. Suitable for permanent installation embedded within a bathroom wall between standard studs the dehumidifying embodiment contains a modified upper return air plenum in which an internal bulkhead 22, together with an extended internal bulkhead 9A effectively partition this upper structure into three separate cavities or plenums including the exhaust plenum 23, the return air plenum 11A, and the intake plenum 24. Internal moveable baffle 25 associated with bulkhead 22, moveable baffle 26 associated with internal bulkhead 9A, and moveable baffle 27 associated with the wall of enclosure 1 are connected by means of a common linkage 28 such that they actuate in concert when solenoid 29 is energized, and are subsequently reset to their normal towel heating position as illustrated in FIG. 3 by return spring 30. As shown in this normal substantially airtight towel heating position baffle 25 is disposed in contact with and thus forms a substantially airtight closure over an air passageway through bulkhead 22, baffle 26 is disposed out of contact with and thereby allows air to pass freely through an air passageway in bulkhead 9A, baffle 27 is disposed in contact with and thus forms a substantially airtight closure over a multiply perforated air passage section 31 of the wall of enclosure 1, thereby maintaining a substantially airtight enclosure 1 and continuous circulation of heated air therein. When solenoid 29 is periodically energized for short time intervals linkage 28 causes baffles 25, 26 and 27 to move in unison such that baffle 27 moves out of contact with the wall of enclosure 1 allowing room air to pass freely into the intake plenum 24 and thus into the supply blower 12, baffle 26 moves into contact with bulkhead 9A forming a substantially airtight seal which isolates the intake plenum from the air return plenum, and baffle 25 moves out of contact with bulkhead 22 allowing heated moisture laden air to pass through the exhaust plenum and thus out of the enclosure 1. Exhaust may be through an air duct 32 if available or alternatively, through a multiply perforated section of the wall of enclosure 1 opposite the intake plenum.

Referring to FIG. 4, the sixth means main control to establish the predetermined time and temperature range is provided by the heating cycle timer and temperature controller 34 which includes therein electrical circuitry to provide a predetermined period of time to determine the users intent, a predetermined period of time for the heating cycle, a predetermined time for preheating the towel prior to low duty cycle periodic ejection of moisture laden air for dehumidifying, and a predetermined temperature range for the stream of air within antechamber 20. Controller 34 couples the power for the resistance coil heater 18 dependent on the internal hot air temperature, the power for low duty cycle operation of solenoid 29 for dehumidification, and the power for blowers 12 and 17 for a predetermined period of time established by any known timer circuit.

In operation a "potential" heating cycle is initiated by the door open start switch 35, a normally open switch (during intervals when door 2 is closed) being actuated (closed) when the door 2 opens, thus starting a short duration timer, on the order of three seconds, within the electronic controller 34. If the door is subsequently closed within this short time duration, door close switch 36, a normally closed switch (during door 2 closed intervals) and which had previously opened when the door 2 was opened, closes, starting an "actual" heating cycle. If the door does not close within this short time interval the control electronics assumes the users intent was to insert or extract a towel and an "actual" heating cycle does not occur. It is noted that switches 35 and 36 are break before make, that is, upon opening the door 2, switch 36 opens before switch 35 closes and similarly when the door is closed switch 35 opens before switch 36 closes. This heating cycle will continue until either the user opens the door 2 to remove the towel, or the maximum heating time is reached and the heating cycle is automatically terminated by the controller 34. The controller couples power to the blowers 12 and 17 throughout the heating cycle without interruption, with the power to the heater 18 being interrupted by the temperature control switch 37 and/or the bimetallic over temperature cutoff switch 38, only temperature control switch 37 being under direct control of and subject to interruption by temperature controller 34. A temperature sensor 19 is located in the path of the stream of air in close proximity to where it first encounters the towel such that it measures the hottest temperature applied to the towel. By this means, a temperature high enough to achieve rapid heat transfer to the towel can be maintained within the antechamber 20 without any danger of scorching the towel. The bimetallic over temperature cutoff switch 38 is located within the coils of the resistance coil heater as shown in FIG. 2, it will temporarily remove power to the heater coils if the blower fans cease to function or if insufficient air passes through the heater coils to cool them within their proper operating temperature range.

The control arrangement as shown in FIG. 4 is such that during a heating cycle the controller 34 will supply power continuously to blowers 12 and 17 and power to the heater coil 18 which will be interrupted by the temperature control switch 37 when the temperature of the air stream reaches the maximum desired level, the power to the resistance coil will then be restored when the air temperature impinging on the towel drops approximately 5 degrees to its lower desired level thus establishing a predetermined temperature range. The maximum time of the heating cycle is selected to be longer than the time consumed by a normal shower or bath so that the warm towel will be available to the occupant of the shower or bath whenever they complete yhr shower or bath, but the unit will "timeout", shutting off all power automatically should the individual fail to open the access door 2 for any reason.

A further function of the heating cycle timer and temperature controller as shown in FIG. 4 is to closely monitor the time lapses separating actuation of the access door 2 such that two full cycle actuations in close sequence is interpreted by the control electronics as the users intent to use the dehumidifying feature in a lingerie drying mode. In this operational mode the normal "time-out" feature is extended for a prolonged time, during which both heating and the short duration periodic ejection of moisture laden air continues unabated. The user is still able to stop the drying process and turn the unit off simply by opening the access door at any time prior to the automatic termination caused by the control electronics at the end of the "extended time-out" period.

Referring again to FIG. 1, the door open switch 35 and door close switch 36 are embedded within the substantially airtight enclosure and actuated upon opening the door, they are not directly available to the user and are thus "transparent" to the user. The user does not have direct access to any electrical switch or component of any kind but rather controls the operation of the towel warmer exclusively by means of the controller logic through manipulation of the access door 2. The hot air towel warmer in accordance with the principles of the present invention is illustrated in an enclosure 1 suitable for permanent installation embedded within the wall of a bathroom between standard studs wherein it resembles a medicine cabinet. Access to the towel for insertion and removal is through an opening 21 in the front wall of enclosure 1, this opening being effectively closed whenever door 2 is closed thereby maintaining the essentially airtight characteristic of enclosure 1.

Referring to FIG. 2, the tandem orientation of blowers 12 and 17 in accordance with the principles of the present invention is evident as is the pressure accumulator action of both cavity 13 and the temperature controlled antechamber 20.

Figure 5:
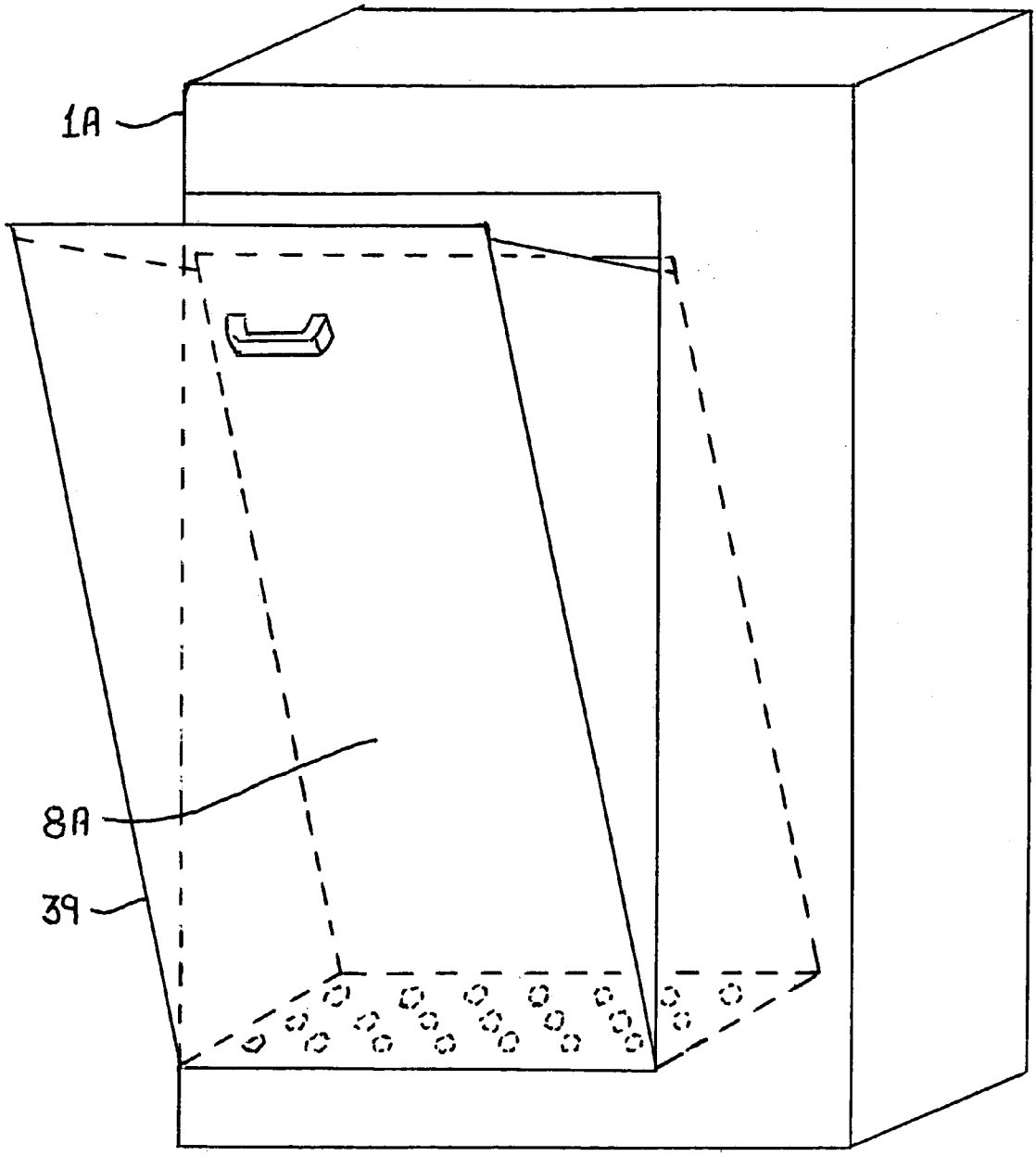
FIG. 5 is a perspective view of a third embodiment for permanently securing the hot air towel warmer in a bathroom embedded within the wall between adjacent studs in accordance with the principles of the present invention this embodiment features a rotating member to both hold the towel and aid in its insertion and removal, illustrated with the rotating access door open.

Referring to FIG. 5, there is illustrated another embodiment of a tandem blower hot air towel warmer in accordance with the principles of the present invention suitable for permanent installation embedded within a bathroom wall between standard studs wherein the cavity 8A in which the towel is heated consists of a free to rotate member 39 embedded within the essentially airtight enclosure 1A and in which the front wall of member 39 and the front wall of the enclosure 1A are one and the same.

Figure 6:
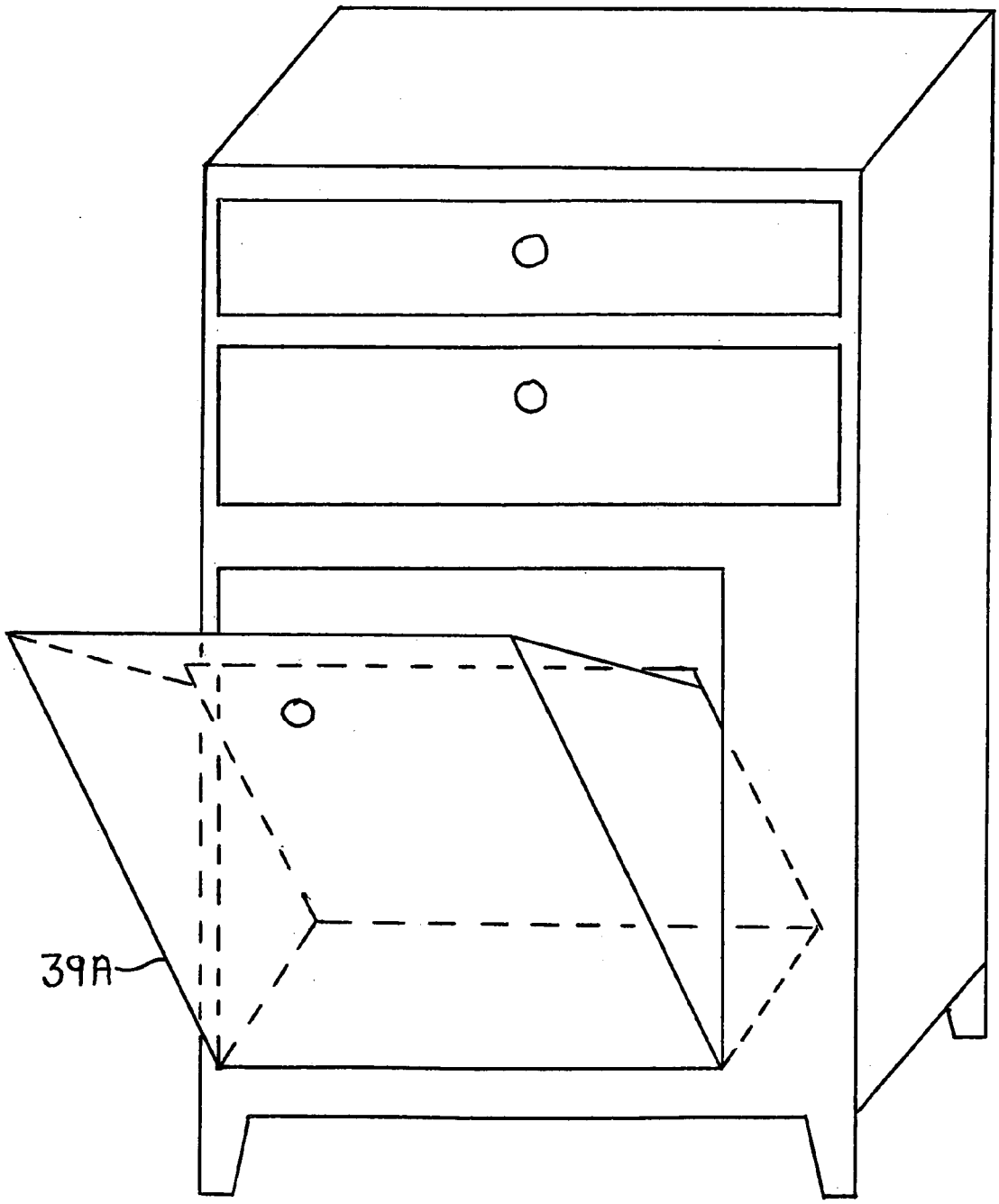
FIG. 6 is a perspective view of a fourth embodiment for placing the hot air towel warmer within a free standing cabinet in close proximity to a tub or shower with the access door open in accordance with the principles of the present invention.

Referring to FIG. 6, there is illustrated another embodiment of the tandem blower configured towel warmer in accordance with the principles of the present invention embedded within a free standing cabinet, in this case a drawer cabinet for storing towels and the like, with the free to rotate member 39B shown open.

While I have described above the principles of my invention in connection with specific apparatus, it is to be clearly understood that this description is made only by way of example and not as a limitation to the scope of my invention as set forth in the objects thereof and in the accompanying claims.

What I claim as my invention is:

1. A forced hot air towel warmer and dehumidifier comprising:

a substantially airtight enclosure having a sealable access means to enable placing a towel and the like to be warmed in the substantially airtight enclosure and to enable removing a warmed towel therefrom;

first means disposed within the substantially airtight enclosure having air passages there through to support the towel;

second means disposed within the substantially airtight enclosure to draw air from above the towel to be warmed and thereby to create and pre-pressurize a stream of air;

third means disposed within the substantially air tight enclosure adjacent the second means, to further pressurize and continuously circulate the stream of air within the substantially airtight enclosure;

fourth means disposed within the substantially air tight enclosure adjacent the third means to heat the stream of air;

fifth means disposed within the substantially air tight enclosure adjacent the fourth means containing a temperature sensor and comprising a constant temperature antechamber in which a volume of pressurized air maintained within a predetermined temperature range is caused to continuously impinge on the towel to be heated;

sixth means disposed within the substantially air tight enclosure associated with said stream of air, said second means said third means said fourth means and said fifth means to detect and determine a user's intent, to automatically maintain said stream of pressurized air at a temperature within a predetermined temperature range for a given period of time, and to control the air flow direction either totally within or through the enclosure;

seventh means disposed between the towel heating cavity and said second means to selectively direct the air flow to either recycle within said substantially air tight enclosure or to periodically pass through the enclosure;

eighth means associated with said substantially air tight enclosure to enable permanent installation of said hot air towel warmer within a bathroom to prevent said hot air towel warmer from falling into a selected one of a tub or shower;

said eighth means including a cavity disposed in a wall of said bathroom between adjacent studs of said wall, said cavity being disposed adjacent said selected one of a tub or shower to permanently receive said substantially air tight enclosure, said sealable access means being disposed in an exposed surface of said substantially air tight enclosure, and an electrical power source disposed in said wall connected to said sixth means and thereby controlling power to said second, third and fourth means.

2. A towel warmer and dehumidifier according to claim 1, wherein said sealable access means includes a door disposed in a front surface of said substantially air tight enclosure.

3. A towel warmer and dehumidifier according to claim 2, wherein said first means includes a shelf having perforations there through disposed intermediate the bottom of said substantially airtight enclosure and between a first internal bulkhead and front, back and side walls of said substantially airtight enclosure.

4. A towel warmer and dehumidifier according to claim 3, wherein said second means includes an air blower and associated pressure accumulator cavity disposed between two internal bulkheads, two internal partitions and a back and side wall of said substantially air tight enclosure to create and pre-pressurize said stream of air.

5. A towel warmer and dehumidifier according to claim 4, wherein said third means includes an air blower pneumatically disposed in tandem with said second means such that their respective pressures are additive and mechanically disposed between two internal bulkheads and a back and side wall of said substantially air tight enclosure to further pressurize and continuously circulate said stream of air.

6. A towel warmer and dehumidifier according to claim 5, wherein said fourth means includes a resistance coil heater to heat said stream of air disposed immediately adjacent said third means.

7. A towel warmer and dehumidifier according to claim 6, wherein said fifth means includes a pressurized essentially constant temperature cavity or antechamber containing a temperature sensor and disposed immediately below the first means between the first internal bulkhead and the bottom, side, front and back walls of said substantially air tight enclosure.

8. A towel warmer and dehumidifier according to claim 7, wherein said sixth means includes a heating cycle timer and temperature controller having an input coupled to a power source, a first power output coupled to said tandem blowers, a second power output source coupled to said resistance coil heater, a third power output source coupled to said dehumidifying control solenoid, a first normally open and second normally closed switch to allow the controller to determine the users intent and thereby to initiate and end the heating cycle, a temperature sensor disposed mechanically within the temperature controlled antechamber immediately adjacent the first means shelf and remote from the heater to allow the controller to detect and maintain the temperature of said stream of air as it impinges on the towel, a bimetallic over temperature cutoff switch disposed within the coils of said resistance coil heater and disposed electrically between said second power output source and said heater.

9. A towel warmer and dehumidifier according to claim 8, wherein said seventh means includes a sequentially actuated dehumidifying control solenoid and associated mechanically linked baffles located within a multiple plenum return air path to selectively direct the air flow to either recycle within said substantially air tight enclosure or to periodically pass through the enclosure.

10. A towel warmer and dehumidifier according to claim 1, wherein said eighth means includes a cavity disposed in a wall of said bathroom between adjacent studs of said wall, said cavity being disposed adjacent said selected one of a tub or shower to permanently receive said substantially air tight enclosure, said sealable access means includes a rotating member to hold the towel to be heated, said member having a closed front integral with the sealable access means, closed back and sides, a substantially open top, and a perforated bottom providing said first means, an electrical power source disposed in said wall connected to said sixth means and thereby controlling power to said second, third, fourth and seventh means.

11. A towel warmer and dehumidifier according to claim 1, further including means associated with said substantially air tight enclosure to enable permanent installation in free standing bathroom, nursery, or other appropriate household cabinetry.

12. A towel warmer and dehumidifier according to claim 11, wherein said substantially air tight enclosure includes a rotating member to hold the towel to be heated, said member having a closed front integral with the sealable access means, closed back and sides, a substantially open top, and a perforated bottom providing said first means.

13. A towel warmer and dehumidifier according to claim 1, further including multiple second means as required in order to accept various towel size and material density variations while generating adequate pressure necessary to achieve the desired towel heating time versus temperature performance.

14. A towel warmer and dehumidifier according to claim 1, wherein said sixth means includes a heating cycle timer and temperature controller having an input coupled to a power source, a first power output coupled to said tandem blowers, a second power output source coupled to said resistance coil heater, a third power output source coupled to said dehumidifying control solenoid, a first normally open and second normally closed switch to allow the controller to determine the users intent and thereby to initiate an "extended time-out" period during which the towel warmer may be utilized as a delicate garment dryer capable of drying a single delicate garment such as feminine lingerie.

15. A forced hot air towel warmer comprising:

a substantially airtight enclosure having a sealable access means to enable placing a towel and the like to be warmed in the substantially airtight enclosure and to enable removing a warmed towel therefrom;

first means disposed within the substantially airtight enclosure having air passages there through to support the towel;

second means disposed within the substantially airtight enclosure and consisting of an air blower and associated pressure accumulator cavity to draw air from above the towel to be warmed and thereby to create and pre-pressurize a stream of air;

third means disposed within the substantially air tight enclosure adjacent the second means, and pneumatically disposed in tandem with said second means such that their respective pressures are additive to further pressurize and continuously circulate the stream of air within the substantially airtight enclosure;

fourth means disposed within the substantially air tight enclosure adjacent the third means and consisting of a resistance coil heater to heat the stream of air;

fifth means disposed within the substantially air tight enclosure adjacent the fourth means containing a temperature sensor and comprising a constant temperature antechamber in which a volume of pressurized air maintained within a predetermined temperature range is caused to continuously impinge on the towel to be heated;

sixth means disposed within the substantially air tight enclosure associated with said stream of air, said second means said third means said fourth means and said fifth means to detect and determine a user's intent, and to automatically maintain said stream of pressurized air at a temperature within a predetermined temperature range for a given period of time;

seventh means associated with said substantially air tight enclosure to enable permanent installation of said hot air towel warmer within a bathroom to prevent said hot air towel warmer from falling into a selected one of a tub or shower;

said seventh means including a cavity disposed in a wall of said bathroom between adjacent studs of said wall, said cavity being disposed adjacent said selected one of a tub or shower to permanently receive said substantially air tight enclosure, said sealable access means being disposed in an exposed surface of said substantially air tight enclosure, and an electrical power source disposed in said wall connected to said sixth means and thereby controlling power to said second, third and fourth means.

16. A towel warmer according to claim 15, wherein said sixth means includes a heating cycle timer and temperature controller having an input coupled to a power source, a first power output coupled to said tandem blowers, a second power output source coupled to said resistance coil heater, a first normally open and second normally closed switch to allow the controller to ascertain the users intent and thereby to initiate and end the heating cycle, a temperature sensor disposed mechanically within the temperature controlled antechamber immediately adjacent the first means shelf and remote from the heater to allow the controller to detect and maintain the temperature of said stream of air as it impinges on the towel, a bimetallic over temperature cutoff switch disposed within the coils of said resistance coil heater and disposed electrically between said second power output source and said heater.

17. A towel warmer according to claim 16, wherein said substantially air tight enclosure includes a rotating member to hold the towel to be heated, said member having a closed front integral with the sealable access means, closed back and sides, a substantially open top, and a perforated bottom providing said first means.

18. A towel warmer according to claim 16, further including means associated with said substantially air tight enclosure to enable permanent installation in free standing bathroom, nursery, or other appropriate household cabinetry.

* * * * *